US010799785B2

(12) United States Patent
Baillie

(10) Patent No.: US 10,799,785 B2
(45) Date of Patent: Oct. 13, 2020

(54) EWHISTLE

(71) Applicant: Earle Eugene Baillie, Anderson, SC (US)

(72) Inventor: Earle Eugene Baillie, Anderson, SC (US)

( * ) Notice: Subject to any disclaimer, the term of this patent is extended or adjusted under 35 U.S.C. 154(b) by 205 days.

(21) Appl. No.: 16/002,235

(22) Filed: Jun. 7, 2018

(65) Prior Publication Data

US 2019/0374841 A1 Dec. 12, 2019

(51) Int. Cl.

*G04G 17/00* (2013.01)
*A63B 71/06* (2006.01)
*G07C 1/28* (2006.01)

(52) U.S. Cl.

CPC ..... *A63B 71/0622* (2013.01); *G07C 1/28* (2013.01); *A63B 2071/0625* (2013.01); *A63B 2220/805* (2013.01); *A63B 2225/50* (2013.01); *G04G 17/005* (2013.01)

(58) Field of Classification Search

CPC ..... G04F 8/00; G04G 17/005; G04G 17/00; G04G 7/02; G04G 15/00; G04G 13/00; G04G 13/028; A63B 2071/0625; A63B 71/0622; A63B 2220/805; A63B 2225/50

See application file for complete search history.

(56) References Cited

U.S. PATENT DOCUMENTS 3,691,752 A * 9/1972 Whittier ..... G04B 19/202 368/72
6,603,711 B2 * 8/2003 Calace ..... A63B 71/0605 368/10
7,561,494 B2 * 7/2009 Stern ..... G04G 17/005 340/323 R
9,605,845 B2 * 3/2017 Chien ..... F21V 33/0076
2003/0054905 A1 * 3/2003 King, Jr. ..... A63B 24/0021 473/467
2003/0058744 A1 * 3/2003 Calace ..... A63B 71/0605 368/109
2006/0060199 A1 * 3/2006 Lampotang ..... A61M 16/0084 128/205.13
2006/0227667 A1 * 10/2006 Stern ..... G04G 17/005 368/110
2010/0080087 A1 * 4/2010 Shupp ..... G01C 17/00 368/14
2011/0248856 A1 * 10/2011 Obenchain ..... A61M 16/20 340/606
2015/0202521 A1 * 7/2015 Abdelmalek .... A41D 19/01523 2/20

(Continued)

*Primary Examiner* — Sean Kayes

(57) ABSTRACT

An electronic whistle system pertains to an electronically activated handheld whistle with a transmitter and receiver modules, for use at various sports games, is disclosed. The transmitter module is configured to send a serialized pulse signal to the receiver module for regulating the start and stop of the game clock. The transmitter module comprises an optical sensor on the opposite side of a vane, which occludes an optical sensor beam when the whistle is blown. A microcontroller sends a serialized pulse signal from the transmitter module to the receiver module. The receiver module intercepts the received signal on the detection of correct serial number, the receiver module will send a STOP pulse to the game clock via a cable. The electronic whistle system is designed to dramatically reduce the errors in the timing aspect of various games.

18 Claims, 9 Drawing Sheets

(56) References Cited

U.S. PATENT DOCUMENTS

| | | | | |
|---|---|---|---|---|
| 2016/0096066 | A1* | 4/2016 | Goldberg | A63B 59/20 473/513 |
| 2017/0193764 | A1* | 7/2017 | D'Angelo | G08B 7/06 |
| 2018/0024683 | A1* | 1/2018 | Ely | G06F 3/0414 345/174 |
| 2018/0064402 | A1* | 3/2018 | Leydon | A61B 5/0871 |
| 2018/0085544 | A1* | 3/2018 | Holyoake | A61M 16/0666 |

* cited by examiner

EWHISTLE

BACKGROUND OF THE INVENTION

A. Technical Field

The present invention generally relates to an electronic whistle system. More specifically, the invention pertains to an electronically activated handheld whistle with a transmitter and a receiver for use at various sports games by an official. The electronic whistle system is configured to transmit an electronically coded signal, to instantly start or stop time keeping clocks for any sports games.

B. Description of Related Art

Generally, in some games (e.g., soccer, football, basketball), the officials utilize whistles or other similar devices. The officials presiding over the game, when using the whistle, the whistle indicates change in game phases (e.g., when a play is over) or violation of rules. Further, a timekeeper is associated with many sporting events who is responsible for keeping track of the remaining time for a particular game or phase of a game. The remaining time is also tracked using an official game clock that can be seen by the players and bystanders alike.

However, in some games, the operation of the game clock is associated with the whistle signals provided by the officials or referee presiding over the game. For example, a whistle is required to be used to indicate, when the game clock should be stopped and when the game clock should resume. It is important that the timekeeper should be able to hear the signals coming from the whistle, so that accurate time is maintained.

Typically, in every case, when the whistle is blown while the game is in progress, the game clock must stop. In the starting, the game clock start varies depending upon the situation and conditions. For instance, in basketball, the game clock does not start until the ball is touched after it is thrown from the sideline or baseline. In that instance, the whistle should not be blown when the ball contacts the player.

Further, to start play after the game has been held up by an official, and the game has to be restarted, with the exception of a designated break or at the games end, this can be achieved, by activating the whistle sound with the transmitted signal to be sent to the receiver whereby the game could be resumed. This depends on the decision of the official or the needs of the game, that are being played, or the action that the official has resorted to, to satisfy the criteria of that game.

Therefore, there is a need for an electronic whistle system; when blown, stops the game clock within a few milliseconds, dramatically reducing timing errors. Further, the electronic whistle system is required to be of a pea-less style to be operable in all kinds of weather conditions.

SUMMARY OF THE INVENTION

The present invention generally relates to an electronic whistle system. More specifically, the invention pertains to an electronically activated handheld whistle with a transmitter and a receiver, for use at various sports games, by an official. The electronic whistle system when activated, transmits an electronically coded signal, which will start or stop one or more time keeping clocks at that game.

In an embodiment, the electronic whistle system or the transmitter module comprises a membrane switch, a mouthpiece, a housing, a transmitter antenna and batteries inside the housing. Further, a vane extending through the sidewall into the housing of the electronic whistle system. The vane comprises a pivoting shaft and an optical sensor to provide the reliability of operation. The pivoting shaft has an o-ring through the side wall to prevent water intrusion into the electronic whistle system.

In one embodiment, the flexible transmitter antenna is spring wound to minimize length. A foam padded finger loop is provided with the electronic whistle system to keep the electronic whistle system and the transmitter out of the way, when the official needs to use both of their hands during the course of the game. The membrane switch is a momentary switch and when depressed; instructs the microprocessor to send a pulse to the receiver, turning on or stopping the game clock.

In one embodiment, the electronic whistle system is configured to employ a vane controlled optical sensor inserted in the whistle from the transmitter module side. When the official blows the whistle to stop play of the game, the opposite end of the vane occludes the optical sensor beam in the transmitter module and the microcontroller sends a serialized pulse signal from the transmitter. The serialized pulse signal is encoded on a carrier and travels at the speed of light to the receiver of the game clock. The receiver intercepts the serialized pulse signal. If the received serialized pulse signal is found to be the correct serial number, the receiver will send a STOP pulse via a cable to the remote port on the game clock, stopping the game time immediately.

In one embodiment, the receiver module is configured with a housing, and a non-skid, non-marking feet. The plastic housing is weighted to sit flat on the table with an antenna oriented vertically. The receiver module is configured to receive a serialized pulse signal with the antenna. The battery cells are replaced just before the game starts to insure the system is operable throughout the game. In an embodiment, the battery hatch is configured to slide open to allow easy access to the batteries for replacement. The receiver module is provided with various adapters to interface with most game clock controllers. In one embodiment, non-skid, non-marking feet are configured to be adhesively bonded to the bottom of the housing. The receiver module is turned on or off with a toggle tactile membrane switch. A LED indicator is incorporated to indicate its active/non-active condition.

In an embodiment, the transmitter module and receiver module are configured to be paired. The batteries are put in the whistle to activate the transmitter module and the receiver module. For some instances to set pairing, blowing the whistle for a stipulated time period, and maintaining the transmitter module within a defined distance from the receiver module, the transmitter module could be paired with the receiver module.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1:
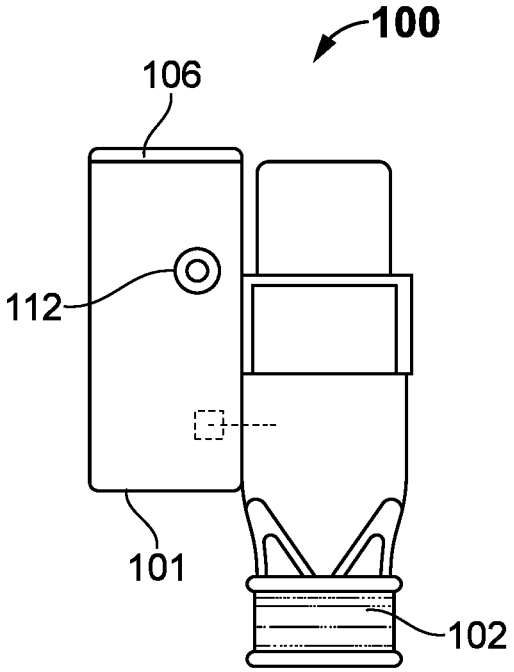
FIG. 1 shows a top view of an electronic whistle system with a transmitter module, according to an embodiment of the present invention.

Referring to FIG. 1, a top view of an electronic whistle system/transmitter module 100, is disclosed. In an embodiment, the electronic whistle system 100 comprises a membrane switch 101, a mouthpiece 102, a housing 111, a transmitter antenna 107 and one or more batteries 106 inside the housing 111. Further, a vane 103 extending through the sidewall into the housing 111 of the electronic whistle system 100. The vane 103 comprises a pivoting shaft 104 and an optical sensor 105 to provide the reliability of operation. The vane 103 extends out away from the wall of the whistle housing 111, so the vane 103 will not freeze unless the whole electronic whistle system 100 is covered with snow or ice. The pivoting shaft 104 comprises an o-ring through the side wall to prevent water intrusion into the electronic whistle system 100. In one embodiment, the mouthpiece 102 is made of food grade silicone rubber cushion. The electronic whistle system 100 is powered with replaceable 2 AAA batteries, which could be installed just before the start of the game. In some embodiments, the electronic whistle system 100 is provided with a rechargeable Li-ion battery, a smart charger chip, and an adapter.

Figure 2:
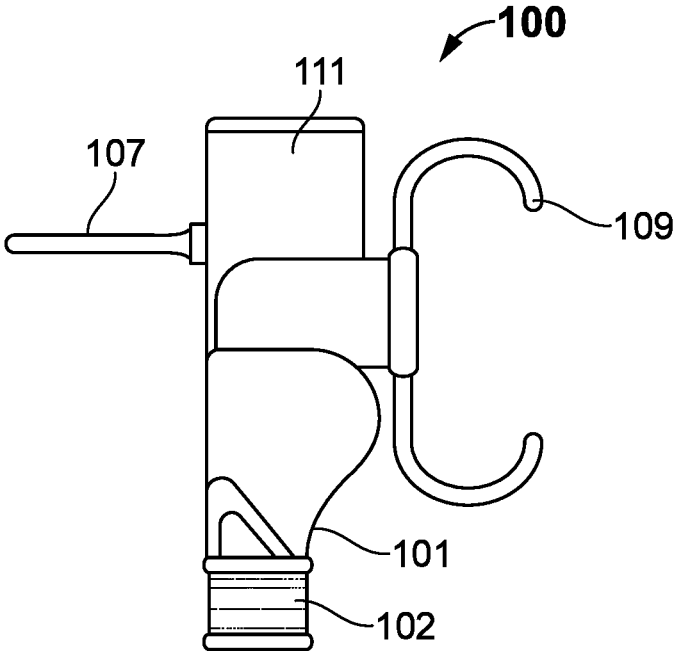
FIG. 2 illustrates a side view of the electronic whistle system with the transmitter module, according to an embodiment of the present invention.
Figure 3:
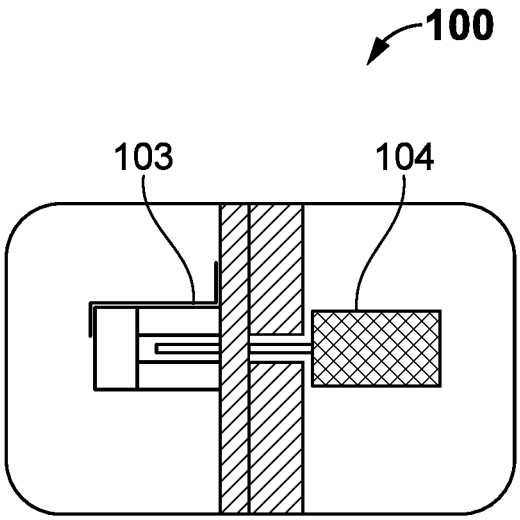
FIG. 3 shows a vane extending inside the housing of the electronic whistle system, according to an embodiment of the present invention.
Figure 8:
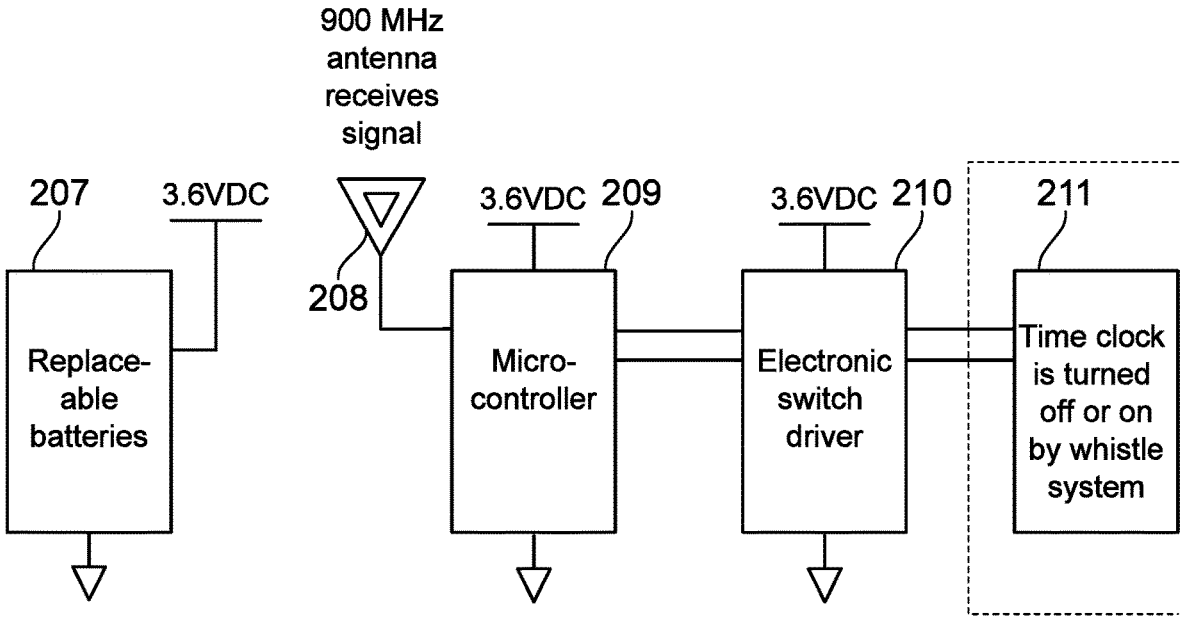
FIG. 8 illustrates a conceptual block diagram of the receiver module, according to an embodiment of the present invention.

In an embodiment, the flexible transmitter antenna 107 is spring wound to minimize length as shown in FIG. 2. A foam padded finger loop 109 is provided with the electronic whistle system 100 to keep the electronic whistle system 100 and the transmitter 110 out of the way, when the official needs to use both of their hands during the course of the game. The plastic housing 111 is assembled onto the body of the electronic whistle system 100. In one embodiment, to start the game clock 211 in the receiver module 200 as shown in FIG. 8, the official has to touch the membrane switch mounted on the front surface of the transmitter module 100 with their thumb. The membrane switch 101 is a momentary switch and when depressed; instructs the microprocessor to send a pulse to the receiver 200, turning on the game clock 211. FIG. 3 shows a vane 103 extending inside the housing 111 of the electronic whistle system 100, according to an embodiment of the present invention. The vane 103 comprises a pivoting shaft 104 and an optical sensor 105 to provide the reliability of operation. The vane 103 extends out away from the wall of the whistle housing 111, so the vane 103 will not freeze unless the whole electronic whistle system 100 is covered with snow or ice. The pivoting shaft 104 has an o-ring through the side wall to prevent water intrusion into the electronic whistle system 100.

Figure 4:
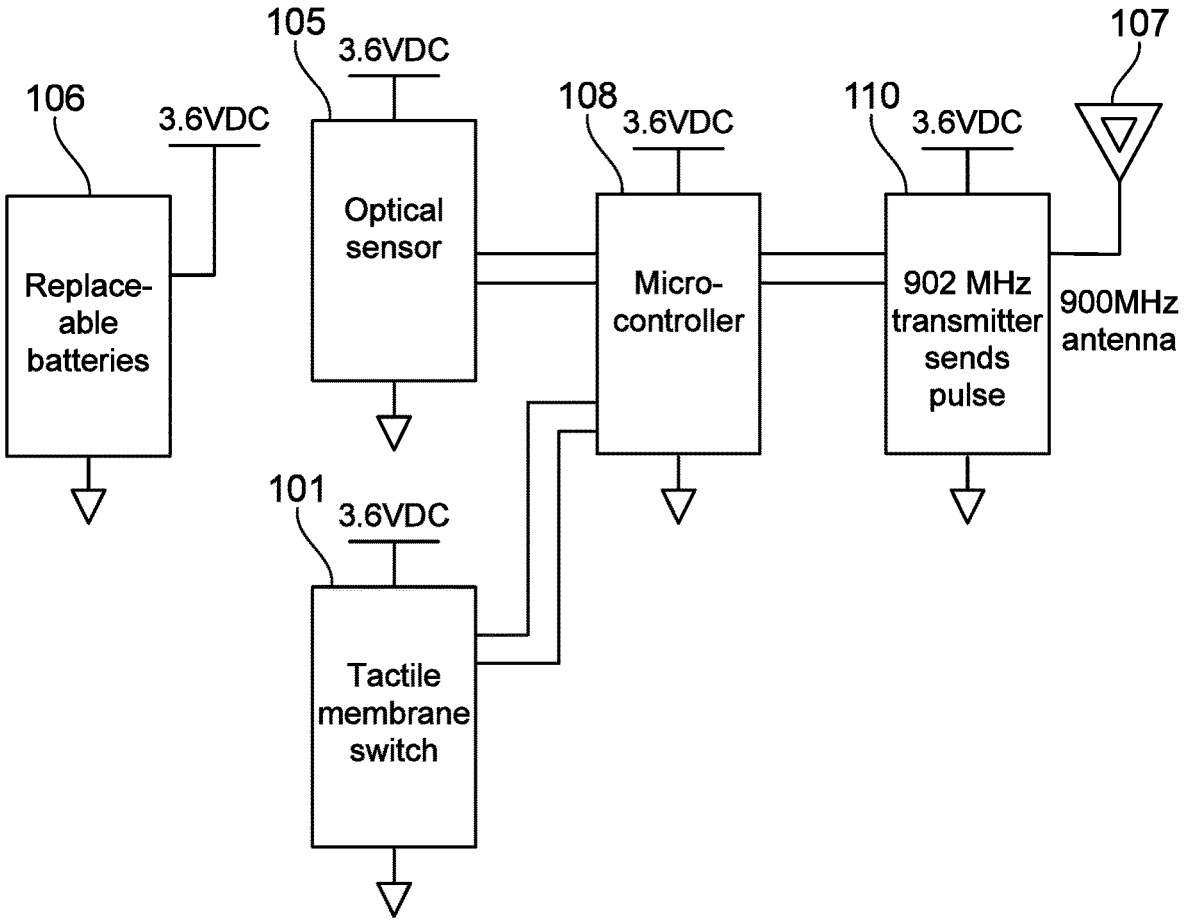
FIG. 4 illustrates a conceptual block diagram of the electronic whistle system with the transmitter module, according to an embodiment of the present invention.

FIG. 4 illustrates a conceptual block diagram of the electronic whistle system with the transmitter module, showing the functionality and connections of different components. In an embodiment, the electronic whistle system 100 configured to employ a vane 103 controlled optical sensor 105 inserted in the whistle from the transmitter module side. When the official blows the whistle to stop the game, the opposite end of the vane 103 occludes the optical sensor beam in the transmitter module, and the microcontroller 108 sends a serialized pulse signal from the transmitter 110. The serialized pulse signal is encoded on a carrier and travels at the speed of light to the receiver 200 of the game clock 211. The receiver 200 intercepts the serialized pulse signal. If the received serialized pulse signal is found to be the correct serial number, the receiver 200 send a STOP pulse via a cable 202 to the remote port on the game clock 211, stopping the game time immediately. Further, to start the game clock 211, the receiver 200 sends the next pulse.

In one embodiment, the microcontroller 108 sends a pulse signal at 902 MHz from the transmitter 110. In some embodiments, the serialized pulse signal is a serialized 500 msec pulse signal. The pulse signal is encoded on the 902 MHz carrier and travels at the speed of light to the receiver module 200 near the game clock controller 211. The electronic whistle system 100 is configured to provide two options to the official to start the clock, either by blowing the whistle, or by depressing the tactile membrane switch 101 near the mouthpiece 102 of the transmitter module 100. Either of these actions may be used to produce a serialized pulse signal from the transmitter 110, to re-start the game clock 211. In some embodiments, the housing 111 is made of injection molded polypropylene plastic. Said plastic is durable, and highly resistant to ultraviolet degradation. The electronic whistle system 100 and the housing 111 could be provided in almost any vibrant colors.

In an embodiment, the electronic whistle system 100 is a pea-less whistle. The pea-less whistle is molded as a complete unit with the finger loop 109 and finger loop support, after the finger loop 109 and finger loop support being molded as separate units. The electronic whistle system 100 is machined on a CNC milling center after molding to accept the small vane 103. The finger loop 109 is padded with comfortable foam to cushion the fingers and prevent slippage during use. In an embodiment, the housing 111 for the transmitter module is configured in a rectangular shape and molded in three sections. The upper part is molded in two sections, which are adhesively bonded together to make them splash-proof. The lower section is configured to accept the replaceable batteries and permanently snaps onto the upper module. The battery holder has a sliding door that protects the batteries until replacement.

Figure 5:
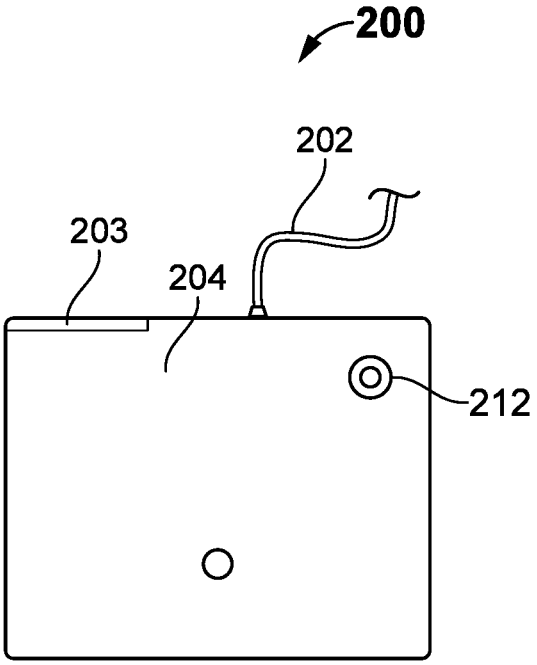
FIG. 5 shows a top view of a receiver module, according to an embodiment of the present invention.
Figure 6:
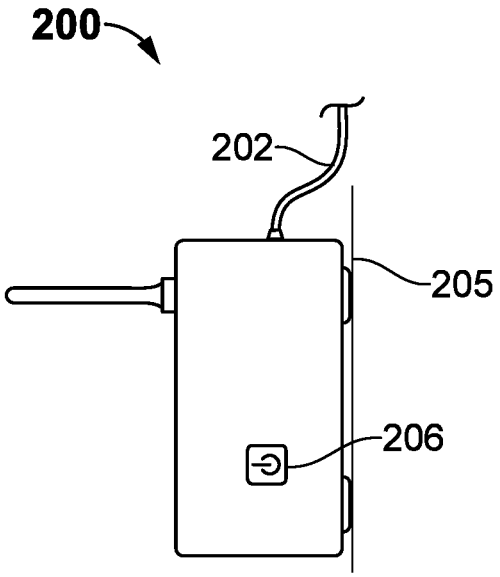
FIG. 6 illustrates a side view of the receiver module, according to an embodiment of the present invention.
Figure 7:
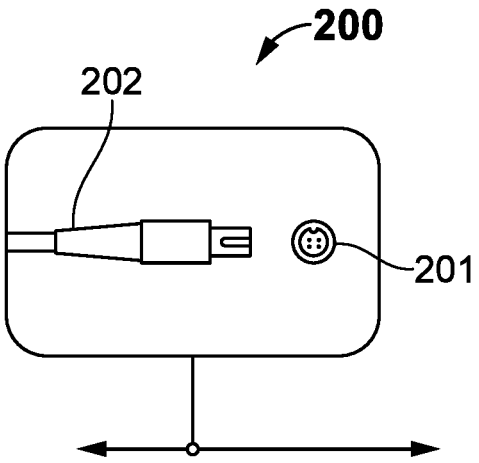
FIG. 7 shows a connection system in the receiver module, according to an embodiment of the present invention.

Referring to FIG. 5, a top view of the receiver module 200 is disclosed. In an embodiment, the receiver module 200 is configured with a housing 204, and a non-skid, non-marking feet 205. The plastic housing 204 could be placed flat on the table with an antenna 208 oriented vertically. The receiver module 200 is configured to receive a serialized pulse signal with the antenna 208, as shown in FIG. 6. The receiver module 200 is further configured with a battery hatch 203 to shelter two each AA cells. The cells are replaced just before the game starts, to insure system is operable throughout the game. In one embodiment, the battery hatch 203 is configured to slide open to allow easy access for replacing batteries. FIG. 7 shows a connection system in the receiver module 200, according to an embodiment of the present invention. 4 pin connector 201 is provided on one end with a 6' cable 202, attached to the receiver module 200. The receiver module 200 is provided with various adapters to interface with most game clock controllers 209. In one embodiment, non-skid, non-marking feet 205 are configured to be adhesively bonded to the bottom of the housing 204. In one embodiment, the receiver module 200 comprises a toggle tactile membrane switch 206. The receiver module 200 is turned on or off by the toggle tactile membrane switch 206. The receiver module 200 comprises a LED indicator 212 on the top of the housing 204. In one embodiment, the LED indicator 212 glows green to indicate active condition. The connections and functionalities of different components of the receiver module 200 is shown in FIG. 8.

In some embodiments, the 6' SEOW jacketed cable 202 is terminated with the 4 wire polarized pin connector 201. Additional adapters are provided to fit almost all remote ports of the game clock 211. The microcontroller 209 is configured with a very low power requirement, 8 bit RISC, solitary chip microcontroller operating at 16 MHz. The microcontroller 209 has onboard chip flash memory. In one embodiment, the microcontroller 209 is provided with 256 KB flash and 32 KB RAM, which could be further increased through the use of external sources. Further, the antenna 208 is spring wound and rubber covered to improve durability. The receiver module 200 comprises a crystal oscillator stabilized frequency synthesizer. Input sensitivity of the receiver module 200 is programmable through external resistors, where the current consumption is very low. In another embodiment, the antenna, microcontroller, switch used in both transmitter and receiver module (100 and 200) respectively, are identical and provides same functionality. Printed circuit boards (PCBs) for both transmitter and receiver modules 100 and 200 respectively are fabricated with the standard thickness. Double sided FR4 circuit board material is populated with surface mounted components. Both circuit boards are designed to have all the components oriented, so they could be mounted with the LED indicators (112 and 212) projecting out of the lenses mounted in the housings (111 and 204) respectively. After assembly, the PCBs are protected with a moisture adsorption preventive conformal coating.

Figure 9:
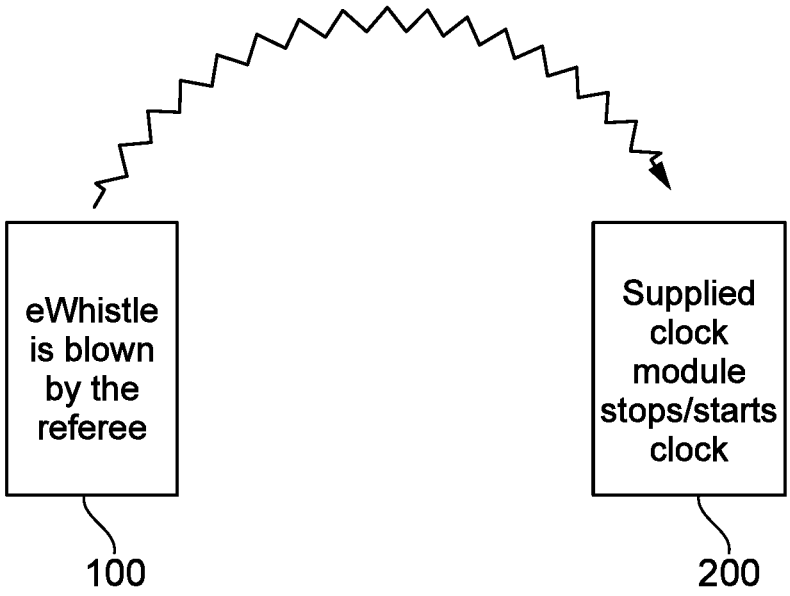
FIG. 9 illustrates pairing of both the transmitter module and the receiver module, according to an embodiment of the present invention

In one embodiment, the transmitter module 100 and receiver module 200 are configured to be paired, as shown in FIG. 9. The batteries 106 are inserted into the whistle to activate the transmitter module 100, and the receiver module 200. Further, blowing the whistle within a stipulated time and keeping the transmitter module 100 within a pre-defined distance from the receiver module, will pair the transmitter module 100 with the receiver module 200.

The electronic whistle system 100 is an innovative game system designed to dramatically reduce the errors in the timing aspects of various games. The system comprises an electronic whistle used by the officials or referee presiding the game. On blowing the electronic whistle system 100, the game clock 211 stops within a few milliseconds, which dramatically reduces timing errors of any games. The game clock 211 is also stopped or started by depressing a button on the front side of the transmitter module 200 with the thumb. In one embodiment, the electronic whistle system 100 is powered with replaceable batteries, which will last for 2 to 3 games in normal operation. The electronic whistle system 100 is provided with pea-less style of whistle, which operates in all kind of weather. The components of both the transmitter module 100 and receiver module 200 are splash-proof and are coated to prevent moisture adsorption, allowing the whistle to be used in any atmospheric condition.

Preferred embodiments of this invention are described herein, including the best mode known to the inventors for carrying out the invention. It should be understood that the illustrated embodiments are exemplary only, and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

The invention claimed is:

1. An electronically activated handheld whistle, comprising:

a transmitter transmitting an electrically coded signal to start or stop a timekeeping clock and a receiver is configured to receive a serialized pulse signal from the timekeeping clock and wherein the handheld whistle includes a vane extending through the sidewall into the housing of the electronic whistle system and wherein the vane includes a pivoting shaft and an optical sensor.

2. An electronically activated handheld whistle as in claim 1, wherein the handheld whistle is used at a game by an official.

3. An electronically activated handheld whistle as in claim 1, wherein the pivoting shaft includes an o-ring through a side wall of the housing to prevent water intrusion into the electronic whistle system.

4. An electronically activated handheld whistle as in claim 1, wherein the antenna is spring wound to minimize length.

5. An electronically activated handheld whistle as in claim 1, wherein the handheld whistle includes a foam padded finger loop to keep the electronic whistle system and the transmitter out of the way, when the official needs to use both of their hands during the course of the game.

6. An electronically activated handheld whistle as in claim 1, wherein the electronically activated handheld whistle includes a membrane switch being a momentary switch and when depressed; instructs the microprocessor to send a pulse to the receiver, turning on the game clock.

7. An electronically activated handheld whistle as in claim 1, wherein the vane controlled optical sensor is inserted in the whistle from the transmitter module side.

8. An electronically activated handheld whistle as in claim 7, wherein the vane occludes the optical sensor beam in the transmitter module and the microcontroller sends a serialized pulse signal from the transmitter when the official blows the whistle to stop play of the game.

9. An electronically activated handheld whistle as in claim 8, wherein the serialized pulse signal is encoded on a carrier and travels at the speed of light to a receiver of the game clock.

10. An electronically activated handheld whistle as in claim 9, wherein the receiver of the game clock intercepts the serialized pulse signal, and the receiver sends a STOP pulse via a cable to the remote port on the game clock, stopping the game time immediately if the correct serial number is received.

11. An electronically activated handheld whistle as in claim 1, wherein the receiver is configured with a housing, and a non-skid, non-marking feet.

12. An electronically activated handheld whistle as in 11 wherein the housing is weighted to sit flat on a support surface with an antenna oriented vertically.

13. An electronically activated handheld whistle as in claim 1 wherein the receiver is configured to receive a serialized pulse signal with the antenna.

14. An electronically activated handheld whistle as in claim 1, wherein the receiver includes a multitude of adapters to interface with a multitude of game clock controllers.

15. An electronically activated handheld whistle as in claim 1, wherein the receiver includes a toggle tactile membrane switch to turn on and turn off the receiver.

16. An electronically activated handheld whistle as in claim 1, wherein the receiver includes A LED indicator to indicate the active/non-active condition.

17. An electronically activated handheld whistle as in claim 1, wherein the transmitter and the receiver are configured to be paired.

18. An electronically activated handheld whistle as in claim 1, wherein the handheld whistle includes a membrane switch, a mouthpiece, a housing, a transmitter antenna and batteries.

* * * * *